US012534679B2

(12) United States Patent
Kojima

(10) Patent No.: US 12,534,679 B2
(45) Date of Patent: Jan. 27, 2026

(54) LUBRICANT BASE OIL AND LUBRICANT COMPOSITION

(71) Applicant: IDEMITSU KOSAN CO., LTD., Tokyo (JP)

(72) Inventor: Kentaro Kojima, Tokyo (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 18/717,205

(22) PCT Filed: Dec. 9, 2022

(86) PCT No.: PCT/JP2022/045395

§ 371 (c)(1),
(2) Date: Jun. 6, 2024

(87) PCT Pub. No.: WO2023/112842

PCT Pub. Date: Jun. 22, 2023

(65) Prior Publication Data

US 2025/0034472 A1 Jan. 30, 2025

(30) Foreign Application Priority Data

Dec. 15, 2021 (JP) ..... 2021-203469

(51) Int. Cl.

| | |
|---|---|
| ***C10M 101/02*** | (2006.01) |
| *C10N 20/02* | (2006.01) |
| *C10N 30/02* | (2006.01) |
| *C10N 40/25* | (2006.01) |

(52) U.S. Cl.

CPC ..... *C10M 101/02* (2013.01); *C10M 2203/1025* (2013.01); *C10N 2020/02* (2013.01); *C10N 2030/02* (2013.01); *C10N 2040/25* (2013.01)

(58) Field of Classification Search

CPC ..... C10M 101/02; C10M 105/02; C10M 105/04; C10M 2203/1025; C10M 2205/028; C10N 2020/02; C10N 2030/02; C10N 2040/25; C10N 2030/06; C10N 2030/54

See application file for complete search history.

(56) References Cited

U.S. PATENT DOCUMENTS

| | | | | |
|---|---|---|---|---|
| 2010/0075875 | A1* | 3/2010 | Yaguchi | C10M 169/04 508/192 |
| 2018/0327688 | A1 | 11/2018 | Naitou et al. | |
| 2018/0327689 | A1* | 11/2018 | Shinoda | C10M 105/06 |
| 2021/0253928 | A1 | 8/2021 | Lacroix et al. | |
| 2021/0253971 | A1* | 8/2021 | Lacroix | C09K 21/08 |
| 2021/0269694 | A1* | 9/2021 | Lacroix | C10M 171/02 |

FOREIGN PATENT DOCUMENTS

| | | | |
|---|---|---|---|
| JP | 2001-115179 | A | 4/2001 |
| JP | 2005-154471 | A | 6/2005 |
| JP | 2013-522409 | A | 6/2013 |
| JP | 2018-168259 | A | 11/2018 |
| JP | 2021-524533 | A | 9/2021 |
| JP | 2021-524537 | A | 9/2021 |
| WO | WO 2006/101019 | A1 | 9/2006 |
| WO | WO 2011/113851 | A1 | 9/2011 |
| WO | WO 2020/011885 | A1 | 1/2020 |
| WO | WO 2020/011886 | A1 | 1/2020 |
| WO | WO 2020/175595 | A1 | 9/2020 |

OTHER PUBLICATIONS

International Search Report issued Feb. 14, 2023 in PCT/JP2022/045395, filed on Dec. 9, 2022, 3 pages.

Extended European Search Report issued on Oct. 23, 2025, in corresponding European Patent Application No. 22907369.7 citing documents 1 and 2 therein.

* cited by examiner

*Primary Examiner* — Ellen M McAvoy

(74) *Attorney, Agent, or Firm* — Oblon, McClelland, Maier & Neustadt, L.L.P.

(57) ABSTRACT

A lubricant base oil for use in the preparation of a cooling lubricant composition, may have a % CP of 60 or more, and the dynamic viscosity at 40° C. is less than 3 $mm^2/s$. Such a lubricant base oil may include a base oil (A) having % $C_P$ of 60 or more and a kinematic viscosity at 40° C. of less than 3 $mm^2/s$, the base oil (A) being 80% by mass or more of the total lubricant base oil mass. Such a lubricant base oil may further include a base oil (B) that is different from the base oil (A), in a range of from 1 to 20% by mass of the total lubricant base oil mass. The base oil (A) may be an isoparaffin-based base oil. Such a lubricant base oil may have a % $C_N$ of 21 or less. A cooling lubricant composition may include such a lubricant base oil.

20 Claims, No Drawings

LUBRICANT BASE OIL AND LUBRICANT COMPOSITION

CROSS-REFERENCE TO RELATED APPLICATIONS

The present application is the national stage of international application PCT/JP2022/045395, filed on Dec. 9, 2022, and claims the benefit of the filing date of Japanese Appl. No. 2021-203469, filed on Dec. 15, 2021.

TECHNICAL FIELD

The present invention relates to a lubricant base oil and a lubricant composition, and for example, relates to a lubricant composition to be used for cooling devices for electric vehicles, and a lubricant base oil to be used for preparing the composition.

BACKGROUND ART

Recently, carbon dioxide reduction has been strongly desired from the viewpoint of global environmental protection. In the field of automobiles, efforts have been concentrated on the development of fuel saving technologies, and hybrid cars and electric cars which are excellent in fuel-saving performance and environmental performance have been becoming widely used. Hybrid cars and electric cars are equipped with an electric motor, an electrical generator, an inverter, a storage battery, etc. and run using power of the electric motor.

When the temperature of a device for electric vehicles such as an electric motor and a battery becomes high, it causes decrease in efficiency and breakage and therefore it is required to cool the device. For cooling electric motors and electrical generators in hybrid cars and electric cars, existing lubricants such as automatic transmission fluid (hereinafter referred to as ATF) and continuously variable transmission fluid (hereinafter referred to as CVTF) are mainly used. Further, there are hybrid cars and electric cars having a gear speed reducer. For this reason, lubricant compositions to be used for them are required to have not only lubricity, but also cooling performance. For example, Patent Document 1 discloses a lubricating composition for cooling and/or insulating a battery or electric motor in a Kinetic Energy Recovery System (KERS) or hybrid vehicle.

Cooling performance of lubricant compositions includes low viscosity for cooling to reduce temperatures of various devices, and high flash point for preventing ignition of various devices at the time of cooling. In general, low viscosity and high flash point are in a trade-off relationship, and therefore it is difficult to achieve a balance between these properties. Studies have been made to achieve a balance between them.

Further, recently, from the viewpoint of global environmental protection and energy saving, fuel-saving performance has been highly needed, and lubricants having fuel-saving performance have been desired.

PRIOR ART DOCUMENTS

Patent Documents

Patent Document 1: Japanese National-phase PCT Laid-Open Patent Publication No. 2013-522409

SUMMARY OF THE INVENTION

Under such circumstances, it has been desired to improve properties including cooling performance and fuel-saving performance of cooling lubricant compositions.

Means for Solving the Problems

The present invention includes embodiments described below.

[1] A lubricant base oil to be used for preparing a cooling lubricant composition, wherein % $C_P$ is 60 or more and the kinematic viscosity at 40° C. is less than 3 $mm^2/s$.

[2] The lubricant base oil according to item [1], which contains a base oil (A) having % $C_P$ of 60 or more and a kinematic viscosity at 40° C. of less than 3 $mm^2/s$, wherein the content of the base oil (A) is 80% by mass or more relative to the total mass of the lubricant base oil.

[3] The lubricant base oil according to item [1] or [2], which further contains a base oil (B) that is different from the base oil (A), wherein the content of the base oil (B) is 1 to 20% by mass relative to the total mass of the lubricant base oil.

[4] The lubricant base oil according to any one of items [1] to [3], wherein the base oil (A) is an isoparaffin-based base oil.

[5] The lubricant base oil according to any one of items [1] to [4], wherein % $C_N$ is 21 or less.

[6] A cooling lubricant composition comprising the lubricant base oil according to any one of items [1] to [5].

[7] The cooling lubricant composition according to item [6], wherein the content of the lubricant base oil is 30% by mass or more relative to the total mass of the cooling lubricant composition.

[8] The cooling lubricant composition according to item [6] or [7], which has a kinematic viscosity at 40° C. of less than 3 $mm^2/s$.

[9] The cooling lubricant composition according to any one of items [6] to [8], which has a flash point of 90° C. or higher.

[10] The cooling lubricant composition according to any one of items [6] to [9], which has a pour point of −45° C. or lower.

[11] The cooling lubricant composition according to any one of items [6] to [10], which is used for cooling a device for electric vehicles.

[12] The cooling lubricant composition according to item [11], wherein the device for electric vehicles is at least one selected from a motor, a battery, an inverter, and an engine.

[13] A cooling device for cooling a device for electric vehicles, the cooling device comprising the cooling lubricant composition according to any one of items [6] to [12].

[14] A method for cooling a device for electric vehicles, the method including cooling the device for electric vehicles by circulating the cooling lubricant composition according to any one of items [6] to [12] through the device for electric vehicles.

Advantageous Effect of the Invention

A cooling lubricant composition excellent in properties such as cooling performance and fuel-saving performance, and a lubricant base oil to be used for the composition are provided.

MODE FOR CARRYING OUT THE INVENTION

Hereinafter, embodiments of the present invention will be described in detail.

Note that the present invention is not limited to the below-described embodiments and can be arbitrarily changed and then carried out without departing from the gist of the present invention.

The upper limits and the lower limits of the numerical ranges described in this specification can be arbitrarily combined. For example, when "A to B" and "C to D" are described, numerical ranges "A to D" and "C to B" are also included in the present invention. Further, the numerical range "the lower limit to the upper limit" described in this specification means the lower limit or more but the upper limit or less.

One aspect of the present invention relates to a lubricant base oil (hereinafter also simply referred to as "base oil") having % $C_P$ of 60 or more and a kinematic viscosity at 40° C. of less than 3 $mm^2/s$. The base oil is used for preparing a cooling lubricant composition. Further, one aspect of the present invention relates to a cooling lubricant composition (hereinafter also simply referred to as "lubricant composition") containing the lubricant base oil.

The lubricant composition of the aspect contains the lubricant base oil (component (A)) and further contains another additive (component (B)) according to need.

Hereinafter, the base oil and respective components contained in the lubricant composition according to the aspect will be described in order.

[Component (A): Base Oil]

The base oil is characterized in that it has % $C_P$ of 60 or more and a kinematic viscosity at 40° C. of less than 3 $mm^2/s$. Such a base oil has a high flash point and high low-temperature flowability while having low viscosity, and by blending it in a lubricant, a lubricant composition excellent in cooling performance and fuel-saving performance can be provided.

The base oil has % $C_P$ of 60 or more. When % $C_P$ is less than 60, there is a case where the thermal conductivity is low and sufficient cooling performance (cooling rate) cannot be obtained, and there is a case where fuel efficiency is reduced due to increase in the friction coefficient (traction coefficient). From the viewpoint of cooling performance and fuel-saving performance, % $C_P$ of the base oil is preferably 70 or more, more preferably 75 or more, even more preferably 77 or more, and particularly preferably 80 or more. The upper limit of % $C_P$ of the base oil is not particularly limited, and the higher it is, the better, but for example, % $C_P$ of the base oil is 99 or less, or 95 or less, or 90 or less. In some embodiments, % $C_P$ of the base oil is preferably 60 to 99, more preferably 70 to 99, even more preferably 75 to 99, still more preferably 77 to 95, and particularly preferably 80 to 90.

% $C_N$ of the base oil is preferably 21 or less. When % $C_N$ of the base oil is 21 or less, high thermal conductivity and excellent cooling performance are provided, and in addition, the friction coefficient is lowered (low traction coefficient), and excellent fuel-saving performance can be imparted to the lubricant. % $C_N$ of the base oil is more preferably 20 or less, even more preferably 18 or less, and particularly preferably 16 or less. The lower limit of % $C_N$ of the base oil is not particularly limited and it may be 0, but for example, % $C_N$ of the base oil is 1 or more, or 5 or more, or 10 or more. In some embodiments, % $C_N$ of the base oil is preferably 1 to 21, more preferably 1 to 20, even more preferably 1 to 18, still more preferably 5 to 17, and particularly preferably 10 to 16.

% $C_A$ of the base oil is preferably 10 or less. When % $C_A$ is 10 or less, high thermal conductivity and excellent cooling performance are provided, and in addition, the friction coefficient is lowered (low traction coefficient), and excellent fuel-saving performance can be imparted to the lubricant. % $C_A$ is more preferably 7 or less, and even more preferably 5 or less. The lower limit of % $C_A$ of the base oil is not particularly limited and it may be 0, but for example, % $C_A$ of the base oil is 1 or more, or 2 or more, or 3 or more. In some embodiments, % $C_A$ of the base oil is preferably 1 to 10, more preferably 2 to 7, and even more preferably 3 to 5.

In this specification, % $C_P$, % $C_N$ and % $C_A$ are values obtained by ring analysis (n-d-M method) in accordance with ASTM D3238-95. % $C_P$, % $C_N$ and % $C_A$ respectively represent ratios of carbon atoms belonging to the paraffin content, naphthene content and aromatic content in oil.

The kinematic viscosity at 40° C. (40° C. kinematic viscosity) of the base oil is less than 3 $mm^2/s$. When the 40° C. kinematic viscosity of the base oil is 3 $mm^2/s$ or more, sufficient cooling performance cannot be obtained. From the viewpoint of cooling performance, the 40° C. kinematic viscosity of the base oil is preferably 2.7 $mm^2/s$ or less, more preferably 2.5 $mm^2/s$ or less, and even more preferably 2.4 $mm^2/s$ or less. The lower limit of the 40° C. kinematic viscosity of the base oil is not particularly limited, and the lower it is, the better, but for example, it is 1 $mm^2/s$ or more, or 1.5 $mm^2/s$ or more, or 1.8 $mm^2/s$ or more, or 2 $mm^2/s$ or more. In some embodiments, the 40° C. kinematic viscosity of the base oil is preferably 1 $mm^2/s$ or more but less than 3 $mm^2/s$, more preferably 1.5 $mm^2/s$ to 2.7 $mm^2/s$, even more preferably 1.8 $mm^2/s$ to 2.5 $mm^2/s$, and particularly preferably 2 $mm^2/s$ to 2.4 $mm^2/s$.

The flash point of the base oil is preferably 90° C. or higher, more preferably 100° C. or higher, and even more preferably 105° C. or higher. When the flash point is 90° C. or higher, it is preferred from the viewpoint of safety at the time of handling, and the problem of odor is less likely to occur. From the viewpoint of safety at the time of handling, the higher the flash point is, the better. The flash point of the base oil may be, for example, 130° C. or lower, or 125° C. or lower, or 120° C. or lower. In some embodiments, the flash point of the base oil is preferably 90 to 130° C., more preferably 100 to 125° C., and even more preferably 105 to 120° C.

In this specification, the flash point was measured by the Pensky-Martens closed cup method (PM method) in accordance with JIS K 2265-3:2007.

The base oil has a pour point of preferably −45° C. or lower, more preferably −47° C. or lower, and even more preferably −50° C. or lower. Such a base oil has high low-temperature flowability and fuel-saving performance at low temperatures can be improved. The pour point of the base oil may be, for example, −100° C. or higher, or −90° C. or higher, or −80° C. or higher. In some embodiments, the pour point of the base oil is preferably −100 to −45° C., more preferably −90 to −47° C., and even more preferably −80 to −50° C.

In this specification, the pour point means a value measured in accordance with JIS K 2269:1987 (Testing methods for pour point and cloud point of crude oil and petroleum products).

The base oil has a thermal conductivity of preferably 0.136 W/mK or more, more preferably 0.138 W/mK or more, and even more preferably 0.140 W/mK or more. The higher the thermal conductivity is, the higher the cooling rate is, and excellent cooling performance (high cooling rate) can be imparted to the lubricant. The thermal conductivity of the base oil is preferably 0.200 W/mK or less, more preferably 0.180 W/mK or less, and even more preferably 0.160 W/mK or less.

In this specification, the thermal conductivity means a value measured in accordance with ASTM D7896-19.

The base oil is not particularly limited as long as it satisfies the above-described % $C_P$ and 40° C. kinematic viscosity, and it may be either a mineral oil, a synthetic oil, or a combination of a mineral oil and a synthetic oil.

As the mineral oil, any material may be suitably selected from among mineral oils which are conventionally used as a base oil of a lubricant. Examples thereof include mineral oils obtained by a method in which: a crude oil is subjected to atmospheric distillation to obtain an atmospheric residue; it is subjected to vacuum distillation to obtain a lubricating oil distillate; and it is subjected to at least one treatment selected from among solvent deasphalting, solvent extraction, hydrocracking, solvent dewaxing, catalytic dewaxing, hydrotreating, etc. to perform purification. Mineral oils may be used solely, or two or more of them may be used in combination.

The synthetic oil is not particularly limited, and as the synthetic oil, any material may be suitably selected from among synthetic oils which are conventionally used as a base oil of a lubricant. Examples of the synthetic oil include a naphthene-based compound, a polyolefin-based compound, an isoparaffin-based compound, an aromatic compound, an ether-based compound, an ester-based compound, a glycol-based compound, Gas to Liquid (GTL), and Coal to Liquid (CTL). Synthetic oils may be used solely, or two or more of them may be used in combination.

Preferred examples of the naphthene-based compound include a compound having a ring selected from a cyclohexane ring, a bicycloheptane ring and a bicyclooctane ring.

Preferred examples of the polyolefin-based compound include an α-olefin homopolymer (poly-α-olefin; PAO) or copolymer (for example, ethylene-α-olefin copolymer) and a hydride thereof.

Regarding the ester-based compound, examples of constituent alcohols (units) include a monool such as methanol, ethanol, n-propanol, n-butanol, n-pentanol, n-hexanol, n-heptanol, n-octanol, n-nonanol, n-decanol, n-undecanol, n-dodecanol, n-tridecanol, n-tetradecanol, oleyl alcohol, ethylhexanol, butyloctanol, pentylnonanol, hexyldecanol, heptylundecanol, octyldodecanol, methylheptadecanol, oleyl alcohol, benzyl alcohol, 2-phenethyl alcohol, 2-phenoxyethanol, ethylene glycol monobenzyl ether, ethylene glycol monophenyl ether, diethylene glycol monobenzyl ether, diethylene glycol monophenyl ether, phenol, cresol, xylenol and alkylphenol, ethylene glycol, diethylene glycol, triethylene glycol, polytetramethylene glycol, 1,3-propanediol, 1,4-butanediol, 1,5-pentanediol, 1,6-hexanediol, and polyethylene glycol (hydroxyl groups at both ends), a triol such as trimethylol propane and trimethylol ethane, and a tetraol such as pentaerythritol. Alcohols (units) may be used solely or in combination.

Examples of carboxylic acids (units) constituting an ester include a monocarboxylic acid such as n-butanoic acid, n-pentanoic acid, n-hexanoic acid, n-heptanoic acid, n-octanoic acid, n-nonanoic acid, n-decanoic acid, n-undecanoic acid, n-dodecanoic acid, n-tridecanoic acid, n-tetradecanoic acid, ethylhexanoic acid, butyloctanoic acid, pentylnonanoic acid, hexyldecanoic acid, heptylundecanoic acid, octyldodecanoic acid, methylheptadecanoic acid, oleic acid, benzoic acid, toluic acid, phenylacetic acid and phenoxyacetic acid, and a dicarboxylic acid such as adipic acid, azelaic acid, sebacic acid, 1,10-decamethylene dicarboxylic acid, phthalic acid, isophthalic acid and terephthalic acid. Carboxylic acids (units) may be used solely or in combination.

Preferred examples of the ester consisting of the above-described alcohols and carboxylic acids include: polyglycol benzoic acid esters such as polyethyleneglycol dibenzoate and polypropyleneglycol dibenzoate; linear carboxylic acid hindered esters such as n-octanoic acid tetraester of pentaerythritol and n-octanoic acid triester of trimethylolpropane; diesters such as di-n-octyl azelate and ethylhexyl 1,10-decamethylenedicarboxylate; monoesters such as dodecyl 16-methylheptadecanoate and n-dodecyl 2-heptylundecanoate; and oleyl esters such as oleyl oleate and 16-methylheptadecyl oleate.

Examples of the aromatic compound include an alkylaromatic compound such as alkylbenzene and alkylnaphthalene.

Examples of the ether-based compound include polyphenyl ether.

Examples of the glycol-based compound include a polyglycol oil such as polyoxyalkylene glycol.

Examples of Coal to Liquid (CTL) include a CTL base oil obtained by a direct liquefaction process (e.g., Bergius process) in which coal is broken down, mixed with a solvent, and directly reacted with hydrogen at a high temperature and a high pressure, and a CTL base oil obtained by an indirect liquefaction process (e.g., Fischer-Tropsch process) in which coal is firstly gasified (coal gasification) and raw materials obtained by separation/purification of the produced gas are subjected to a synthesis reaction to perform liquefaction.

Examples of Gas to Liquid (GTL) include a GTL base oil produced by hydroisomerization dewaxing of residual WAX (Gas to Liquid Wax) in the GTL process.

(Base Oil (A))

The base oil preferably contains a base oil (A) having % $C_P$ of 60 or more and a kinematic viscosity at 40° C. of less than 3 $mm^2/s$.

% $C_P$ of the base oil (A) is preferably 70 or more, more preferably 75 or more, even more preferably 77 or more, and particularly preferably 80 or more since not only high thermal conductivity and excellent cooling performance, but also excellent fuel-saving performance are provided. The upper limit of % $C_P$ of the base oil (A) is not particularly limited, and the higher it is, the better, but for example, % $C_P$ of the base oil (A) is 99 or less, or 95 or less, or 90 or less. In some embodiments, % $C_P$ of the base oil (A) is preferably 60 to 99, more preferably 70 to 99, even more preferably 75 to 99, still more preferably 77 to 95, and particularly preferably 80 to 90.

From the viewpoint of cooling performance and/or fuel-saving performance, % $C_N$ of the base oil (A) is preferably 20 or less, more preferably 18 or less, and even more preferably 16 or less. The lower limit of % $C_N$ of the base oil (A) is not particularly limited and it may be 0, but for example, % $C_N$ of the base oil (A) is 1 or more, or 5 or more, or 10 or more. In some embodiments, % $C_N$ of the base oil (A) is preferably 1 to 20, more preferably 5 to 18, and even more preferably 10 to 16.

From the viewpoint of cooling performance and/or fuel-saving performance, % $C_A$ of the base oil (A) is preferably 10 or less, more preferably 7 or less, and even more preferably 5 or less. The lower limit of % $C_A$ of the base oil (A) is not particularly limited and it may be 0, but for example, % $C_A$ of the base oil (A) is 1 or more, or 2 or more, or 3 or more. In some embodiments, % $C_A$ of the base oil (A) is preferably 1 to 10, more preferably 2 to 7, and even more preferably 3 to 5.

From the viewpoint of cooling performance, the kinematic viscosity at 40° C. (40° C. kinematic viscosity) of the base oil (A) is preferably less than 3 $mm^2/s$, more preferably 2.7 $mm^2/s$ or less, even more preferably 2.5 $mm^2/s$ or less, and particularly preferably 2.4 $mm^2/s$ or less. The lower limit of the 40° C. kinematic viscosity of the base oil (A) is not particularly limited, and the lower it is, the better, but for example, it is 1 $mm^2/s$ or more, or 1.5 $mm^2/s$ or more, or 1.8 $mm^2/s$ or more. In some embodiments, the 40° C. kinematic viscosity of the base oil (A) is preferably 1 $mm^2/s$ or more but less than 3 $mm^2/s$, more preferably 1.5 $mm^2/s$ to 2.7 $mm^2/s$, even more preferably 1.8 $mm^2/s$ to 2.5 $mm^2/s$, and particularly preferably 2.2 $mm^2/s$ to 2.4 $mm^2/s$.

The flash point of the base oil (A) is preferably 90° C. or higher, more preferably 100° C. or higher, and even more preferably 105° C. or higher. When the flash point is 90° C. or higher, it is preferred from the viewpoint of safety at the time of handling, and the problem of odor is less likely to occur. From the viewpoint of safety at the time of handling, the higher the flash point is, the better. The flash point of the base oil (A) may be, for example, 130° C. or lower, or 125° C. or lower, or 120° C. or lower. In some embodiments, the flash point of the base oil (A) is preferably 90 to 130° C., more preferably 100 to 125° C., and even more preferably 105 to 120° C.

As the base oil (A), one material may be used solely, or two or more materials may be used in combination. The base oil (A) is not particularly limited as long as it satisfies the above-described % $C_P$ and 40° C. kinematic viscosity, and it may be either a mineral oil, a synthetic oil, or a combination of a mineral oil and a synthetic oil. From the viewpoint of cooling performance, preferred examples of the base oil (A) include a synthetic oil such as a polyolefin-based compound and an isoparaffin-based compound, and an isoparaffin-based mineral oil.

In a preferred embodiment, the base oil (A) is an isoparaffin-based base oil. The isoparaffin-based base oil has excellent cooling performance. As the isoparaffin-based base oil, an isoparaffin-based synthetic oil derived from Gas to Liquid (GTL), an isoparaffin-based synthetic oil derived from Coal to Liquid (CTL) obtained by the indirect liquefaction method, an isoparaffin-based synthetic oil derived from a polymerization product of isobutene, an isoparaffin-based mineral oil or the like can be used.

The content of the base oil (A) is preferably 80% by mass or more, more preferably 82% by mass or more, even more preferably 85% by mass or more, and particularly preferably 90% by mass or more relative to the total mass of the base oil. The upper limit of the content of the base oil (A) is not particularly limited, and it may be 100% by mass. In some embodiments, the content of the base oil (A) is preferably 80 to 100% by mass, more preferably 82 to 100% by mass, even more preferably 85 to 100% by mass, and particularly preferably 90 to 100% by mass relative to the total mass of the base oil. In some embodiments, the content is preferably 80 to 99% by mass, more preferably 82 to 97% by mass, even more preferably 85 to 97% by mass, and particularly preferably 90 to 96% by mass relative to the total mass of the base oil.

(Base Oil (B))

The base oil may contain, in addition to the base oil (A), another base oil that is different from the base oil (A). In some embodiments, the base oil further contains a base oil (B) that is different from the base oil (A). When the base oil (B) is contained, for example, there is an advantage in that the kinematic viscosity at 40° C. (40° C. kinematic viscosity) of the lubricant base oil can be more easily adjusted.

In some embodiments, from the viewpoint of achieving a balance between cooling performance and a traction coefficient, the kinematic viscosity at 40° C. (40° C. kinematic viscosity) of the base oil (B) is preferably 4 to 20 $mm^2/s$, more preferably 4.5 to 15 $mm^2/s$, and even more preferably 5 to 10 $mm^2/s$.

The flash point of the base oil (B) is preferably 90° C. or higher, more preferably 120° C. or higher, and even more preferably 150° C. or higher. When the flash point is 90° C. or higher, it is preferred from the viewpoint of safety at the time of handling, and the problem of odor is less likely to occur. From the viewpoint of safety at the time of handling, the higher the flash point is, the better. The flash point of the base oil (B) may be, for example, 200° C. or lower, or 180° C. or lower, or 170° C. or lower. In some embodiments, the flash point of the base oil (B) is preferably 90 to 200° C., more preferably 120 to 180° C., and even more preferably 130 to 170° C.

As the base oil (B), one material may be used solely, or two or more materials may be used in combination. The base oil (B) is not particularly limited, and it may be either a mineral oil, a synthetic oil, or a combination of a mineral oil and a synthetic oil.

In some embodiments, the base oil (B) is a mineral oil.

In some embodiments, the base oil (B) is a synthetic oil (e.g., polyolefin-based compound).

In some embodiments, the base oil (A) is an isoparaffin-based base oil, and the base oil (B) is a mineral oil or synthetic oil.

In some embodiments, the base oil (A) is an isoparaffin-based base oil, and the base oil (B) is a mineral oil.

In some embodiments, the base oil (A) is an isoparaffin-based base oil, and the base oil (B) is a synthetic oil (e.g., polyolefin-based compound).

The content of the base oil (B) is preferably 20% by mass or less, more preferably 18% by mass or less, even more preferably 15% by mass or less, and particularly preferably 10% by mass or less relative to the total mass of the base oil. In the case where the base oil (B) is contained, the lower limit of the content of the base oil (B) is not particularly limited, and for example, it may be 1% by mass or more, or 3% by mass or more, or 4% by mass or more. In some embodiments, the content of the base oil (B) is preferably 1 to 20% by mass, more preferably 3 to 18% by mass, even more preferably 3 to 15% by mass, and particularly preferably 4 to 10% by mass relative to the total mass of the base oil.

By blending the base oil of the above-described aspect, a lubricant composition can be prepared. The base oil is the main component of the lubricant composition, and usually, the content of the base oil is preferably 30% by mass or more, more preferably 60% by mass or more, even more preferably 65% by mass or more, still more preferably 70% by mass or more, and particularly preferably 80% by mass or more based on the total amount of the composition. For example, the content of the base oil is preferably 30 to 100% by mass, more preferably 60 to 100% by mass, even more preferably 65 to 99.5% by mass, still more preferably 70 to 99% by mass, and particularly preferably 80 to 99% by mass based on the total amount of the composition.

[Component (B): Other Additives]

In the lubricant composition, in addition to the above-described lubricant base oil (component (A)), other additives such as an antiwear agent, an antioxidant, a viscosity index improver, an anti-rust agent, a metal deactivator, an antifoaming agent, a detergent dispersant and a friction modifier may be blended according to need and to an extent that does not inhibit the effect of the present invention.

The total content of the other additives is not particularly limited, but for example, it is about 0 to 40% by mass, or 0.5 to 35% by mass, or 1 to 30% by mass, or 1 to 20% by mass based on the lubricant composition.

(Antiwear Agent)

The antiwear agent is not particularly limited, and any material may be suitably selected from among antiwear agents which are conventionally used for lubricants. For example, in the case where an electric motor and a gear speed reducer are used in combination in a hybrid car or electric car, a neutral phosphorus-based compound, an acidic phosphorous acid ester or an amine salt thereof, a sulfur-based compound, etc. are preferably used in order to avoid reduction in electrical insulation as much as possible.

The content of the antiwear agent is not particularly limited, but for example, it is about 0.01 to 5% by mass based on the total amount of the composition.

Examples of the neutral phosphorus-based compound include: aromatic neutral phosphoric acid esters such as tricresyl phosphate, triphenyl phosphate, trixylenyl phosphate, tricresyl phenyl phosphate, tricresyl thiophosphate and triphenyl thiophosphate; aliphatic neutral phosphoric acid esters such as tributyl phosphate, tri-2-ethylhexyl phosphate, tributoxy phosphate and tributyl thiophosphate; aromatic neutral phosphorous acid esters such as triphenyl phosphite, tricresyl phosphite, trisnonyl phenyl phosphite, diphenylmono-2-ethylhexyl phosphite, diphenylmono tridecyl phosphite, tricresyl thiophosphite and triphenyl thiophosphite; and aliphatic neutral phosphorous acid esters such as tributyl phosphite, trioctyl phosphite, trisdecyl phosphite, tristridecyl phosphite, trioleyl phosphite, tributyl thiophosphite and trioctyl thiophosphite. These substances may be used solely, or two or more of them may be used in combination.

Examples of the acidic phosphorous acid ester include: aliphatic acidic phosphoric acid ester amine salts such as di-2-ethylhexyl acid phosphate amine salt, dilauryl acid phosphate amine salt and dioleyl acid phosphate amine salt; aliphatic acidic phosphorous acid esters and amine salts thereof such as di-2-ethylhexyl hydrogen phosphite, dilauryl hydrogen phosphite and dioleyl hydrogen phosphite; aromatic acidic phosphoric acid ester amine salts such as diphenyl acid phosphate amine salt and dicresyl acid phosphate amine salt; aromatic acidic phosphorous acid esters and amine salts thereof such as diphenyl hydrogen phosphite and dicresyl hydrogen phosphite; sulfur-containing acidic phosphoric acid ester amine salts such as S-octylthioethyl acid phosphate amine salt and S-dodecylthioethyl acid phosphate amine salt; and sulfur-containing acidic phosphorous acid esters and amine salts thereof such as S-octylthioethyl hydrogen phosphite and S-dodecylthioethyl hydrogen phosphite. These substances may be used solely, or two or more of them may be used in combination.

As the sulfur-based compound, various compounds can be used, and specific examples thereof include a thiadiazole-based compound, a polysulfide-based compound, a dithiocarbamate-based compound, a sulfurized fat and oil-based compound and a sulfurized olefin-based compound.

(Antioxidant)

As the antioxidant, any material can be suitably selected from among publicly-known antioxidants which are conventionally used as antioxidants for lubricants.

Examples thereof include an amine-based antioxidant (diphenylamines, naphthylamines), a phenol-based antioxidant, a molybdenum-based antioxidant, a sulfur-based antioxidant, and a phosphorus-based antioxidant. These antioxidants may be used solely, or two or more of them may be used in combination. The content of the antioxidant is not particularly limited, but for example, it is about 0.05 to 7% by mass based on the total amount of the composition.

(Viscosity Index Improver)

Examples of the viscosity index improver include a polymethacrylate, a dispersant polymethacrylate, an olefin-based copolymer (e.g., an ethylene-propylene copolymer), a dispersant olefin-based copolymer, and a styrene-based copolymer (e.g., a styrene-diene copolymer and a styrene-isoprene copolymer). These viscosity index improvers may be used solely, or two or more of them may be used in combination. The blending amount of the viscosity index improver is not particularly limited, but for example, from the viewpoint of the blending effect, it is about 0.5% by mass to 15% by mass based on the total amount of the composition.

(Anti-Rust Agent)

Examples of the anti-rust agent include fatty acid, alkenylsuccinic acid half ester, fatty acid soap, alkyl sulfonate, polyhydric alcohol fatty acid ester, fatty acid amide, oxidized paraffin and alkyl polyoxyethylene ether. These anti-rust agents may be used solely, or two or more of them may be used in combination. The preferred blending amount of the anti-rust agent is not particularly limited, but it is about 0.01% by mass to 3% by mass based on the total amount of the composition.

(Metal Deactivator)

Examples of the metal deactivator include benzotriazole, a triazole derivative, a benzotriazole derivative and a thiadiazole derivative. These metal deactivators may be used solely, or two or more of them may be used in combination. The content of the metal deactivator is not particularly limited, but it is preferably 0.01 to 5% by mass based on the total amount of the composition.

(Antifoaming Agent)

Examples of the antifoaming agent include a silicone-based compound such as dimethylpolysiloxane, and a polyacrylate. These antifoaming agents may be used solely, or two or more of them may be used in combination. The content of the antifoaming agent is not particularly limited, but it is about 0.0001% by mass to 5% by mass based on the total amount of the composition.

(Detergent Dispersant)

Examples of the detergent dispersant include a succinimide compound, a boron-based imide compound and an acid amide-based compound. These detergent dispersants may be used solely, or two or more of them may be used in combination. The content of the detergent dispersant is not particularly limited, but it is preferably 0.01 to 20% by mass based on the total amount of the composition.

As the friction modifier, for example, any material can be suitably selected from among publicly-known friction modifiers which are used as friction modifiers for lubricants. Examples thereof include an organic dithiophosphate, a molybdenum-based friction modifier and an ashless friction modifier. These friction modifiers may be used solely, or two or more of them may be used in combination. The content of the friction modifier is not particularly limited, but it is preferably 0.01 to 20% by mass based on the total amount of the composition.

[Characteristics of Lubricant Composition]

As the lubricant composition, preferred is one which achieves low viscosity and a high flash point for cooling performance.

From the viewpoint of cooling performance, the kinematic viscosity at 40° C. (40° C. kinematic viscosity) of the lubricant composition is preferably less than 3 $mm^2/s$, more preferably 2.8 $mm^2/s$ or less, even more preferably 2.6 $mm^2/s$ or less, and particularly preferably 2.5 $mm^2/s$ or less. The lower limit of the 40° C. kinematic viscosity of the lubricant composition is not particularly limited, and the lower it is, the better, but for example, it is 1 $mm^2/s$ or more, or 1.5 $mm^2/s$ or more, or 1.8 $mm^2/s$ or more. In some embodiments, the 40° C. kinematic viscosity of the lubricant composition is preferably 1 $mm^2/s$ or more but less than 3 $mm^2/s$, more preferably 1.5 $mm^2/s$ to 2.8 $mm^2/s$, even more preferably 1.8 $mm^2/s$ to 2.6 $mm^2/s$, and particularly preferably 2.2 $mm^2/s$ to 2.5 $mm^2/s$.

The flash point of the lubricant composition is preferably 90° C. or higher, more preferably 92° C. or higher, even more preferably 95° C. or higher, and particularly preferably 100° C. or higher. When the flash point is 90° C. or higher, it is preferred from the viewpoint of safety at the time of handling, and the problem of odor is less likely to occur. From the viewpoint of safety at the time of handling, the higher the flash point is, the better. The flash point of the lubricant composition may be, for example, 130° C. or lower, or 125° C. or lower, or 120° C. or lower. In some embodiments, the flash point of the lubricant composition is preferably 90 to 130° C., more preferably 92 to 125° C., even more preferably 95 to 120° C., and particularly preferably 100 to 115° C.

From the viewpoint of low-temperature flowability, the lubricant composition has a pour point of preferably −45° C. or lower, more preferably −47° C. or lower, and even more preferably −50° C. or lower. The higher the low-temperature flowability is, the better the startability is, and fuel-saving performance can be improved in this case. The lower limit of the pour point of the lubricant composition is not particularly limited, and the lower it is, the better, but for example, the pour point of the lubricant composition is −100° C. or higher, or −90° C. or higher, or −80° C. or higher. In some embodiments, the pour point of the lubricant composition is preferably −100 to −45° C., more preferably −90 to −47° C., and even more preferably −80 to −50° C.

From the viewpoint of cooling performance (high cooling rate), the lubricant composition has a thermal conductivity of preferably 0.136 W/mK or more, more preferably 0.138 W/mK or more, and even more preferably 0.140 W/mK or more. The upper limit of the thermal conductivity of the lubricant composition is not particularly limited, and the higher it is, the better, but for example, the thermal conductivity of the lubricant composition is 0.200 W/mK or less, or 0.180 W/mK or less, or 0.160 W/mK or less. In some embodiments, the thermal conductivity of the lubricant composition is preferably 0.136 to 0.200 W/mK, more preferably 0.138 to 0.180 W/mK, and even more preferably 0.140 to 0.160 W/mK.

The traction coefficient of the lubricant composition is preferably 0.028 or less, more preferably 0.026 or less, and even more preferably 0.024 or less. The lower the traction coefficient is, the lower the friction coefficient is, and it leads to fuel saving. The lower limit of the traction coefficient of the lubricant composition is not particularly limited, but it is 0.010 or more, or 0.015 or more, or 0.018 or more. In some embodiments, the traction coefficient of the lubricant composition is preferably 0.010 to 0.028, more preferably 0.015 to 0.026, and even more preferably 0.018 to 0.024.

In this specification, the traction coefficient is measured according to the method described in the Examples which will be described later.

[Intended Use of Lubricant Composition]

The lubricant composition of the present invention described above has lubricity and also has excellent cooling performance (for example, low viscosity and high flash point; moreover, in addition to low viscosity and high flash point, high low-temperature flowability (low pour point) and/or high thermal conductivity). Therefore, it can be suitably used as a cooling lubricant composition for cooling various devices. In particular, it is preferably used for cooling devices for electric vehicles such as electric cars and hybrid cars. For example, it is suitable as an oil for cooling at least one device for electric vehicles selected from a motor, a battery, an inverter, and an engine.

[Cooling Device]

The lubricant composition imparts lubricity and cooling effects to various devices. For example, when the lubricant composition is circulated through various devices such as devices for electric vehicles, it cools such devices while providing lubricity to them. In one embodiment, a cooling device for cooling a device for electric vehicles, which comprises the lubricant composition of the present invention described above, is provided. For example, the lubricant composition is used in a cooling device for cooling at least one device for electric vehicles selected from a motor, a battery, an inverter, and an engine. For example, the lubricant composition can be used in a hydraulic device, a stationary transmission, an automotive transmission or a motor/battery cooling device.

[Method for Producing Lubricant Composition]

The method for producing the lubricant composition is not particularly limited. In one embodiment, the method for producing the lubricant composition includes mixing the component (A) (lubricant base oil), and according to need, the component (B) (other additives). The component (A), and according to need, the component (B) may be blended by any method, and the order for blending and the technique thereof are not limited.

EXAMPLES

Hereinafter, the present invention will be described in detail by way of working examples, but the technical scope of the present invention is not limited thereto.

The measurement of physical properties of raw materials used in Examples and Comparative Examples and lubricant base oils and lubricant compositions in the Examples and Comparative Examples was carried out according to methods described below.

(1) Kinematic Viscosity

The kinematic viscosity at 40° C. (40° C. kinematic viscosity) was measured using a glass capillary viscometer in accordance with JIS K2283:2000.

(2) Flash Point

The flash points of the lubricant base oil and the lubricant composition were measured by two methods.

The flash point (PM) was measured by the Pensky-Martens closed cup method (PM method) in accordance with JIS K 2265-3:2007.

(3) Thermal Conductivity

The thermal conductivities at 40° C. of the lubricant base oil and the lubricant composition were measured using a thermal conductivity measuring device manufactured by C-Therm.

(4) Pour Point

The pour point was measured in accordance with JIS K 2269:1987 (Testing methods for pour point and cloud point of crude oil and petroleum products).

(5) % Cr, % $C_N$, and % $C_A$

% $C_P$, % $C_N$, and % $C_A$ were measured by ring analysis (n-d-M method) in accordance with ASTM D3238-95.

Further, the cooling performance test and the traction coefficient measurement of the lubricant composition in each Example and each Comparative Example were carried out according to methods described below.

(Cooling Performance Test: Surface Temperature after 12 Seconds)

In accordance with the "cooling performance test method: method A" defined in JIS K2242, a silver rod heated to 200° C. was put into 250 mL of sample oil heated to 30° C., and the surface temperature of the silver rod after 12 seconds was measured.

(Traction Coefficient Measurement)

The traction coefficient (MTM) is a value measured using a traction coefficient measuring instrument (product name: MTM2 (Mini Traction Machine 2, manufactured by PCS Instruments), under measurement conditions described below.

(Measurement Conditions)

Firstly, by heating an oil tank with a heater, the oil temperature was set to 40° C., and the traction coefficient with a load of 20 N, at an average rolling speed of 2 m/s, and at a slip rate (SRR) of 50% was measured.

Examples 1 to 6, Comparative Examples 1 to 4

Base oil components shown in Table 1 were mixed to prepare a lubricant base oil, and it was further mixed with other additives to prepare a lubricant composition of each of Examples and Comparative Examples. Evaluation of characteristics, the cooling performance test and the traction coefficient measurement were carried out according to the aforementioned methods. The results are shown in Table 1.

TABLE 1

| | | | | Example 1 | Example 2 | Example 3 | Example 4 | Example 5 | Example 6 |
|---|---|---|---|---|---|---|---|---|---|
| Composition of lubricant composition (% by mass) | Base oil | Base oil (A) | Base oil-1 | 95.00 | 85.00 | 99.00 | 95.00 | | |
| | | | Base oil-2 | | | | | 95.00 | |
| | | | Base oil-3 | | | | | | 95.00 |
| | | Base oil (B) | Mineral oil-1 | | | | | | |
| | | | Mineral oil-2 | | | | | | |
| | | | Mineral oil-3 | 4.00 | 14.00 | | | 4.00 | 4.00 |
| | | | Synthetic oil-1 | | | | 4.00 | | |
| | | Other additives | | Remainder | Remainder | Remainder | Remainder | Remainder | Remainder |
| | Total | | | 100 | 100 | 100 | 100 | 100 | 100 |
| Characteristics of lubricant base oil | Kinematic viscosity | | ($mm^2/s$) | 2.3 | 2.5 | 2.2 | 2.3 | 2.2 | 2.3 |
| | Thermal conductivity | | (W/mk) | 0.141 | 0.141 | 0.141 | 0.141 | 0.140 | 0.140 |
| | Pour point | | (° C.) | −50.0> | −50.0> | −50.0> | −50.0> | −50.0> | −50.0> |
| | Flash point (PM) | | (° C.) | 110 | 110 | 110 | 110 | 106 | 100 |
| | % $C_P$ | | (%) | 80 | 79 | 81 | 80 | 79 | 75 |
| | % $C_N$ | | (%) | 16 | 17 | 15 | 15 | 16 | 21 |
| | % $C_A$ | | (%) | 4 | 4 | 4 | 5 | 5 | 4 |
| Characteristics of lubricant composition | Kinematic viscosity | | ($mm^2/s$) | 2.4 | 2.6 | 2.3 | 2.4 | 2.3 | 2.4 |
| | Thermal conductivity | | (W/mK) | 0.141 | 0.141 | 0.141 | 0.141 | 0.140 | 0.140 |
| | Pour point | | (° C.) | −50.0> | −50.0> | −50.0> | −50.0> | −50.0> | −50.0> |
| | Flash point (PM) | | (° C.) | 110 | 110 | 110 | 110 | 106 | 100 |
| Performance of lubricant composition | Cooling performance test (surface temperature after 12 seconds) (° C.) | | | 116 | 117 | 112 | 115 | 116 | 116 |
| | Traction coefficient (MTM) | | | 0.018 | 0.019 | 0.018 | 0.022 | 0.026 | 0.026 |

TABLE 1-continued

| | | | | Comparative Example 1 | Comparative Example 2 | Comparative Example 3 | Comparative Example 4 |
|---|---|---|---|---|---|---|---|
| Composition of fabricant composition (% by mass) | Base oil | Base oil (A) | Base oil-1 | | | 60.00 | 40.00 |
| | | | Base oil-2 | | | | |
| | | | Base oil-3 | | | | |
| | | Base oil (B) | Mineral oil-1 | 95.00 | | | |
| | | | Mineral oil-2 | | 95.00 | | |
| | | | Mineral oil-3 | 4.00 | 4.00 | 39.00 | 59.00 |
| | | | Synthetic oil-1 | | | | |
| | | Other additives | | Remainder | Remainder | Remainder | Remainder |
| | | Total | | 100 | 100 | 100 | 100 |
| Characteristics of lubricant base oil | Kinematic viscosity | | ($mm^2/s$) | 2.5 | 2.3 | 3.2 | 4.1 |
| | Thermal conductivity | | (W/mk) | 0.136 | 0.138 | 0.141 | 0.142 |
| | Pour point | | (° C.) | −50.0 | −50.0> | −50 | −40 |
| | Flash point (PM) | | (° C.) | 107 | 101 | 112 | 117 |
| | % $C_P$ | | (%) | 47 | 38 | 78 | 76 |
| | % $C_N$ | | (%) | 50 | 51 | 19 | 22 |
| | % $C_A$ | | (%) | 3 | 11 | 3 | 2 |
| Characteristics of lubricant composition | Kinematic viscosity | | ($mm^2/s$) | 2.6 | 2.4 | 3.3 | 4.2 |
| | Thermal conductivity | | (W/mK) | 0.136 | 0.138 | 0.141 | 0.142 |
| | Pour point | | (° C.) | −50 | −50.0> | −50 | −40 |
| | Flash point (PM) | | (° C.) | 107 | 101 | 112 | 117 |
| Performance of lubricant composition | Cooling performance test (surface temperature after 12 seconds) (° C.) | | | 121 | 121 | 121 | 126 |
| | Traction coefficient (MTM) | | | 0.031 | 0.029 | 0.020 | 0.022 |

The components shown in Table 1 are as described below.

1. Lubricant Base Oil

Base Oil (A)

Base oil-1: isoparaffin-based base oil, 40° C. kinematic viscosity of 2.2 $mm^2/s$, flash point (PM) of 110° C., % $C_P$ of 81%

Base oil-2: isoparaffin-based base oil, 40° C. kinematic viscosity of 2.2 $mm^2/s$, flash point (PM) of 106° C., % $C_P$ of 81%

Base oil-3: isoparaffin-based base oil, 40° C. kinematic viscosity of 2.2 $mm^2/s$, flash point (PM) of 100° C., % $C_P$ of 76%

Base Oil (B)

Mineral oil-1: paraffin-based mineral oil, 40° C. kinematic viscosity of 2.4 $mm^2/s$, flash point (PM) of 106° C., % $C_P$ of 44%

Mineral oil-2: aromatic mineral oil, 40° C. kinematic viscosity of 2.2 $mm^2/s$, flash point (PM) of 100° C., % $C_P$ of 36%

Mineral oil-3: paraffin-based mineral oil, 40° C. kinematic viscosity of 7.1 $mm^2/s$, flash point (PM) of 165° C., % $C_P$ of 73%

Synthetic oil-1: PAO (poly-α-olefin), 40° C. kinematic viscosity of 5.1 $mm^2/s$, flash point (PM) of 161° C.

2. Other Additives

Mixture of Metal Deactivator, Antiwear Agent, Friction Modifier, Antioxidant, Detergent Dispersant and Antifoaming Agent As shown in Table 1, the lubricant base oils of Examples 1 to 6 in which % $C_P$ and the 40° C. kinematic viscosity were within specific ranges were excellent in at least one property selected from low 40° C. kinematic viscosity, high thermal conductivity, low pour point (high low-temperature flowability), and high flash point. The lubricant compositions in which the lubricant base oils of Examples 1 to 6 were respectively blended were excellent in at least one property selected from low 40° C. kinematic viscosity, high thermal conductivity, low pour point (high low-temperature flowability), and high flash point. In addition, the lubricant compositions in which the lubricant base oils of Examples 1 to 6 were respectively blended showed a low traction coefficient and a low surface temperature after 12 seconds in the cooling test (high cooling rate, decrease in temperature of the object to be cooled), and it was confirmed that fuel-saving performance and cooling performance were excellent.

Further, regarding Example 3 in which % $C_P$ was higher and the 40° C. kinematic viscosity was lower, the surface temperature after 12 seconds in the cooling test was particularly low, and it was confirmed that cooling performance was particularly excellent.

It is understood that, by using a lubricant base oil with % $C_P$ and 40° C. kinematic viscosity within specific ranges, a lubricant composition, which is excellent in at least one property selected from low 40° C. kinematic viscosity, high thermal conductivity, low pour point (high low-temperature flowability), high flash point, fuel-saving performance (e.g., low traction coefficient), high cooling rate, and decrease in temperature of the object to be cooled, and which has a good balance between these properties, can be obtained.

Accordingly, in some aspects of the present invention, by using a lubricant base oil with % $C_P$ and 40° C. kinematic viscosity within specific ranges, a lubricant composition excellent in fuel-saving performance (e.g., low traction coefficient) and cooling performance (e.g., low surface temperature after 12 seconds (high cooling rate, decrease in temperature of the object to be cooled)) is provided. Further, in a preferred aspect of the present invention, by using a lubricant base oil with % $C_P$ and 40° C. kinematic viscosity within specific ranges, a lubricant composition excellent not only in fuel-saving performance (e.g., low traction coefficient) and cooling performance (e.g., low surface temperature after 12 seconds (high cooling rate, decrease in temperature of the object to be cooled)), but also in at least one property selected from low 40° C. kinematic viscosity, high thermal conductivity, low pour point (high low-temperature flowability), and high flash point, is provided.

On the other hand, the lubricant base oils of Comparative Examples 1 and 2 in which % $C_P$ was smaller than 60 had low thermal conductivity, and the lubricant compositions in which the lubricant base oils of Comparative Examples 1 and 2 were respectively blended had a high traction coefficient, and it was confirmed that fuel-saving performance was poor.

Regarding the lubricant base oils of Comparative Examples 3 and 4 in which the 40° C. kinematic viscosity was 3 $mm^2/s$ or more, the surface temperature after 12 seconds was high (cooling performance test), and sufficient cooling performance was not obtained.

The scope of the present invention is not limited to the description above. In addition to the above-described examples, the present invention can be suitably changed and then practiced within a range in which the effects of the present invention are not reduced. Note that all the documents and publications cited herein are incorporated herein by reference in their entireties regardless of purposes thereof. In addition, the contents disclosed in the claims and specification of Japanese Patent Application No. 2021-203469 (filed on Dec. 15, 2021), to which priority is claimed by the present application, are incorporated herein.

INDUSTRIAL APPLICABILITY

The lubricant composition in which the lubricant base oil of the present invention is blended has excellent cooling performance and fuel-saving performance, and can be used for cooling devices for electric vehicles such as electric cars and hybrid cars. For example, it is suitable as a lubricant for cooling at least one device for electric vehicles selected from a motor, a battery, an inverter, and an engine.

The invention claimed is:

1. A lubricant base oil suitable for preparing a cooling lubricant composition, wherein a % $C_P$ of the lubricant base oil is 60 or more,
wherein a % $C_N$ of the lubricant base oil is from 5 to 21, and
wherein a kinematic viscosity of the lubricant base oil at 40° C. is less than 3 $mm^2/s$.

2. The lubricant base oil of claim 1, comprising:
a base oil (A) having % $C_P$ of 60 or more and a kinematic viscosity at 40° C. of less than 3 $mm^2/s$,
wherein the base oil (A) is present in 80% by mass or more, relative to total lubricant base oil mass.

3. The lubricant base oil of claim 2, comprising:
a base oil (B) that is different from the base oil (A),
wherein the base oil (B) is present in a range of from 1 to 20% by mass, relative to the total lubricant base oil mass.

4. The lubricant base oil of claim 1, wherein the base oil (A) is an isoparaffin-based base oil.

5. A cooling lubricant composition, comprising:
the lubricant base oil of claim 1.

6. The composition of claim 5, wherein the lubricant base oil is present in 30% by mass or more, relative to total cooling lubricant composition mass.

7. The composition of claim 5, having a kinematic viscosity at 40° C. of less than 3 $mm^2/s$.

8. The composition of claim 5, having a flash point of 90° C. or higher.

9. The composition of claim 5, having a pour point of −45° C. or lower.

10. The composition of claim 5, which is suitable for cooling a device configured for electric vehicles.

11. The composition of claim 10, wherein the device is a motor, a battery, an inverter, and/or an engine.

12. A cooling device configured for cooling an electric vehicle device, the cooling device comprising:
the cooling lubricant composition of claim 5.

13. A method for cooling an electric vehicle device, the method comprising:
cooling the electric vehicle device by circulating the cooling lubricant composition of claim 5 through the electric vehicle device.

14. The lubricant base oil of claim 1, comprising:
a base oil (A), which is an isoparaffin-based base oil, having % $C_P$ of 60 or more and a kinematic viscosity at 40° C. of less than 3 $mm^2/s$; and
a base oil (B) that is different from the base oil (A),
wherein the lubricant base oil has a % $C_N$ of 21 or less,
wherein the base oil (A) is present in 80% by mass or more, relative to total lubricant base oil mass, and
wherein the base oil (B) is present in a range of from 1 to 20% by mass, relative to the total lubricant base oil mass.

15. A lubricant base oil suitable for preparing a cooling lubricant composition,
wherein a % $C_P$ of the lubricant base oil is 60 or more,
wherein a % $C_A$ of the lubricant base oil is 10 or less, and
wherein a kinematic viscosity of the lubricant base oil at 40° C. is less than 3 $mm^2/s$.

16. A lubricant base oil suitable for preparing a cooling lubricant composition,
wherein a % $C_P$ of the lubricant base oil is 60 or more,
wherein the flash point of the lubricant base oil is from 90° C. to 110° C., and
wherein a kinematic viscosity of the lubricant base oil at 40° C. is less than 3 $mm^2/s$.

17. The lubricant base oil of claim 15, comprising:
a base oil (A); and
a base oil (B) that is different from the base oil (A),
wherein the base oil (B) is present in a range of from 1 to 20% by mass, relative to the total lubricant base oil mass.

18. The lubricant base oil of claim 16, comprising:
a base oil (A); and
a base oil (B) that is different from the base oil (A),
wherein the base oil (B) is present in a range of from 1 to 20% by mass, relative to the total lubricant base oil mass.

19. A cooling lubricant composition, comprising:
the lubricant base oil of claim 16,
where the composition has a kinematic viscosity at 40° C. of less than 3 $mm^2/s$.

20. A cooling lubricant composition, comprising:
the lubricant base oil of claim 17,
where the composition has a kinematic viscosity at 40° C. of less than 3 $mm^2/s$.

* * * * *